US007535355B2

(12) United States Patent
Barone

(10) Patent No.: US 7,535,355 B2
(45) Date of Patent: May 19, 2009

(54) METHOD AND APPARATUS TO DETECT EVENT SIGNATURES

(75) Inventor: Gerard A. Barone, Orlando, FL (US)

(73) Assignee: L-3 Communications Security and Detection Systems Inc., Woburn, MA (US)

( * ) Notice: Subject to any disclaimer, the term of this patent is extended or adjusted under 35 U.S.C. 154(b) by 300 days.

(21) Appl. No.: 11/212,859

(22) Filed: Aug. 26, 2005

(65) Prior Publication Data

US 2007/0290842 A1 Dec. 20, 2007

Related U.S. Application Data

(60) Provisional application No. 60/604,907, filed on Aug. 27, 2004.

(51) Int. Cl.
*G08B 13/00* (2006.01)

(52) U.S. Cl. ..... 340/566; 340/565; 340/573.1

(58) Field of Classification Search ..... 340/565, 340/566, 567, 573.1, 573.4, 539.26
See application file for complete search history.

(56) References Cited

U.S. PATENT DOCUMENTS

| | | | | |
|---|---|---|---|---|
| 4,096,474 | A * | 6/1978 | Greer et al. | 367/136 |
| 4,415,979 | A * | 11/1983 | Hernandez | 702/56 |
| 4,750,197 | A * | 6/1988 | Denekamp et al. | 455/404.2 |
| 5,790,032 | A | 8/1998 | Schmidt | |
| 5,853,005 | A | 12/1998 | Scanlon | |
| 5,854,993 | A | 12/1998 | Grichnik | |
| 5,939,982 | A * | 8/1999 | Gagnon et al. | 340/539.17 |
| 6,222,442 | B1 | 4/2001 | Gager et al. | |
| 6,370,481 | B1 * | 4/2002 | Gamble | 702/56 |
| 6,474,683 | B1 | 11/2002 | Breed et al. | |
| 6,552,677 | B2 * | 4/2003 | Barnes et al. | 342/22 |
| 6,567,004 | B1 * | 5/2003 | Landa et al. | 340/573.1 |
| 6,793,242 | B2 | 9/2004 | Breed et al. | |
| 6,919,803 | B2 * | 7/2005 | Breed | 340/539.14 |
| 2004/0100379 | A1 * | 5/2004 | Boman et al. | 340/539.26 |
| 2004/0174259 | A1 * | 9/2004 | Peel et al. | 340/539.26 |
| 2004/0178880 | A1 * | 9/2004 | Meyer et al. | 340/5.22 |

OTHER PUBLICATIONS

Kercel et al., "Application of the Smart Portal in Transportation", SPIE, 1997, pp. 231-241; vol. 2902.
W. B. Dress, "Applications of a Fast, Continuous Wavelet Transform", SPIE, 1997, pp. 570-580, vol. 3078.

(Continued)

*Primary Examiner*—George A Bugg
*Assistant Examiner*—Edny Labbees
(74) *Attorney, Agent, or Firm*—Wolf, Greenfield & Sacks, P.C.

(57) ABSTRACT

A security system for use in connection with cargo containers and other enclosed spaces. The system monitors vibrations associated with a container and detects signals representative events indicating that an unauthorized access has been made to the container. The system may be programmed with a library of event signatures, allowing different types of events to be detected. The system may be provided with a library of signatures representing a heart beating with a beat pattern and the system may be used to detect a human or other animal within the container. Alternatively, the system may be provided with a library of signatures representing piercing the container. The system may be used to monitor containers in transit. Indications of events may be stored while the container is in transit and then communicated at a security check point.

23 Claims, 10 Drawing Sheets

OTHER PUBLICATIONS

Avian Heartbeat Detector™; Geovox Security Inc., 2004, 1 page, printed at http://www.geovox.com/index.htm on Jan. 23, 2007.

Search Report from corresponding International Application No. PCT/US05/30351.

* cited by examiner

METHOD AND APPARATUS TO DETECT EVENT SIGNATURES

RELATED APPLICATIONS

This application claims priority under 35 U.S.C. § 119(e) to U.S. Provisional Application Ser. No. 60/604,907, entitled "METHOD AND APPARATUS TO DETECT EVENT SIGNATURES," filed on Aug. 27, 2004, which is herein incorporated by reference in its entirety.

FIELD OF THE INVENTION

This invention relates generally to security systems and more particularly to a system for security systems that detect event signatures.

BACKGROUND

The possibility of detecting concealed people through their heartbeats has been considered. GeoVox Security, Inc. of Houston, Tex. sells an Avion heartbeat detector for security applications. Such detectors operate on the principle that a beating heart creates mechanical shock pulses as it pumps blood through a body. The shock pulses produce vibrations that propagate through the body and through objects in contact with the body.

The vibrations have a very small amplitude—a fraction of the width of a human hair. Nonetheless, sensors exist that can detect such small vibrations. For example, geophones are used in oil exploration. Geophones are sensitive enough to detect vibrations that emanate from a mechanical device and travel long distances through the earth.

A difficulty in using such small amplitude signals in security applications is that there are many other sources of similar signals with a similar or greater magnitude. For purposes of detecting a signal from a beating heart, these signals are noise. A security system is likely to mistake the noise for a signal representing a beating heart, creating a "false alarm."

A false alarm is undesirable in a security system because of the cost of investigating each alarm. For example, in the case of a system checking cargo containers for stowaway passengers, an alarm generated for a container triggers a physical inspection of that container. Physically inspecting the container ties up security personnel and delays shipping operations. Where the inspection is undertaken in response to a false alarm, these costs are wasted. If a security system has a high false alarm rate, its output may be so unreliable that it is ignored or the cost of investigating false alarms may be so great that the system is not used at all.

Security systems are designed so as not to respond to noise and therefore lower their false alarm rates. However, many methods that a system could use to reject noise reduce the sensitivity of the system to a signal the system needs to detect. Reducing the sensitivity to the signal to be detected is also undesirable because it reduces the chances that the desired signal will be missed, creating a false positive. False positives are particularly undesirable in a security system because a threat might be passed undetected.

Accordingly, it is desirable for a security system to have a low false alarm rate while simultaneously providing a low rate of false positives. It would be highly desirable to provide an improved systems for detecting people and other animals from their heartbeats with a low false alarm rate while simultaneously providing a low rate of false positives.

SUMMARY

In one aspect, the invention relates to a container that includes a sensor; a processor, coupled to receive a signal from the sensor and adapted to process the signal to detect a pattern characteristic of an event; and an interface, coupled to the processor and adapted to communicate an indication of whether the pattern was detected.

In another aspect, the invention relates to a method of operating a security system for a container. The method includes monitoring vibrations of the container to detect a vibration signal characteristic representative of an undesired access to the container; storing an indication when the vibration signal characteristic is detected; and taking a security action in response to the stored indication.

In another aspect, the invention relates to a method of detecting an event in relation to a container. The method involves providing a plurality of event signatures, each representing the frequency spectrum of an event signal generated by an event and passing through the container; obtaining a vibration signal representative of vibrations of the container; forming a plurality of frequency domain representations of the vibration signal, each formed from a portion of the vibration signal; comparing each of the plurality of frequency domain representations of the vibration signal to the plurality of event signatures; and detecting an event based on the result of the comparisons of act d).

In a further aspect, the invention relates to a method of detecting a heart beat. The method includes providing a plurality of signatures, each signature being a transformation of a representation of a heart beating; receiving a vibration signal; for each of a plurality of portions of the vibration signal, transforming the portion to form a transformed portion; and comparing each of the plurality of transformed portions to the plurality of signatures to detect whether the vibration signal contains one of the plurality of signatures.

DRAWINGS

The accompanying drawings are not intended to be drawn to scale. In the drawings, each identical or nearly identical component that is illustrated in various figures is represented by a like numeral. For purposes of clarity, not every component may be labeled in every drawing. In the drawings.

DETAILED DESCRIPTION

A system that detects signals by comparing detected signals to signatures in a library is described below. The system can be used to form a security system that detects threat signals. In one embodiment, the signatures are derived from representations of a beating heart, with each signature representing a different heart peat pattern. In a preferred embodiment, the library contains signatures representative of the range of heart beat patterns for a human or other animal that is to be detected. In some embodiments, the library signatures are derived by transforming signals representative of heart beat patterns by a transfer function representative of structures between the beating heart and sensors.

In further embodiments, the signals are processed using one or more frequency domain transforms. In one embodiment, the received signal is processed through a frequency domain transform before being compared to signatures in the library. In this embodiment, the signatures in the library are preferably created using the same transform. In another embodiment, the frequency domain transform is performed on the result of the comparison between the received signal and signatures in the library.

The security system may be employed in various applications. It may be used, for example, to detect a person concealed in an enclosed space. In one embodiment, the system forms a part of a cargo screening system. It may be used to detect stowaways in cargo containers, such as are used to load cargo on vehicles, such as planes and ships. Some embodiments employ the system as a prescanner for other operations that may be harmful to people, including a system that verifies containers do not contain any humans or animals before exposing the container to high levels of radiation. In other embodiments, the system is employed as a part of an intrusion detection system to detect people in prohibited areas, such as hallways, elevators or other enclosed spaces.

In other embodiments, the library signatures are characteristic of events other than a beating heart and the system is used to detect such events. In one embodiment, the library contains signatures indicative of a cargo container being pierced by various means. The system is installed in a cargo yard or holding area for cargo containers and detects unauthorized attempts to open a container. In some embodiments, sensors are attached to a plurality of cargo containers.

Figure 1:
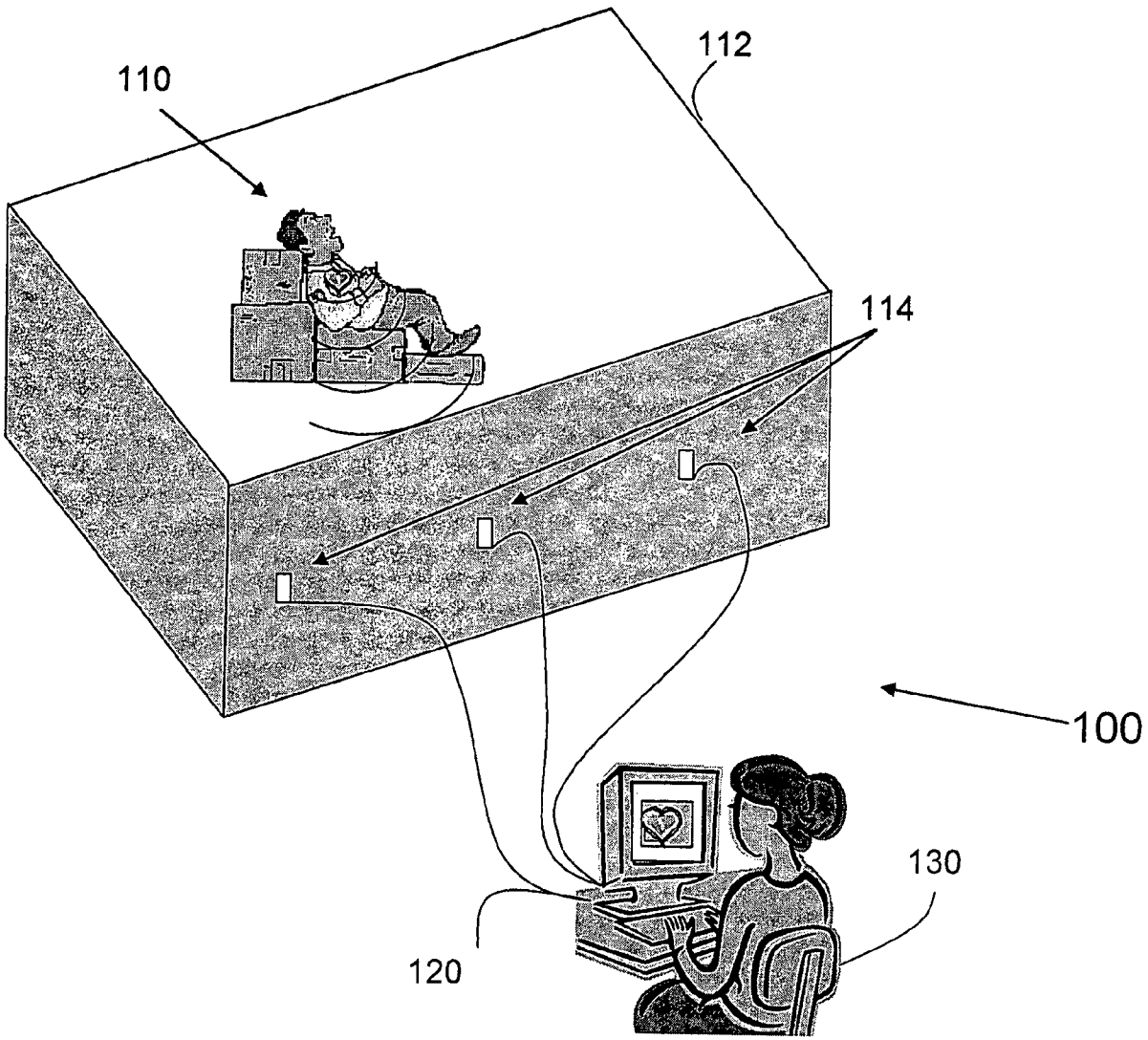
FIG. 1 (prior art)
FIG. 1 is a sketch of a prior art security system detecting a concealed person.

FIG. 1 shows a security system 100 for detecting a person concealed in an enclosed space. In the illustrated embodiment, the security system is used in connection with containerized cargo. System 100 detects a concealed person 110 or other animal inside a cargo container 112. Such a system may be used to screen cargo being loaded or unloaded on vehicles such as airplanes or ships. Such a system may detect stowaways, illegal aliens or other people attempting to travel unobserved.

The system employs multiple sensors 114. Sensors 114 might be geophones, microaccelerometers or other similar sensors designed to detect very small vibrations.

The outputs of the sensors 114 are provided to a computer 120. Here, computer 120 acts as both a data processing station and an operator interface station. Computer 120 receives data from sensors 114 and processes it to detect signals representative of vibrations caused by a beating heart from someone within container 112.

Computer 120 also provides a user interface for the results of this analysis so that a human user 130 may observe the results and take the appropriate action in response. For example, when data analysis indicates a heart beat detected inside container 112, the human operator 130 may search the container, segregate it in a secure area for observation or pass it on for another level of inspection.

Figure 2:
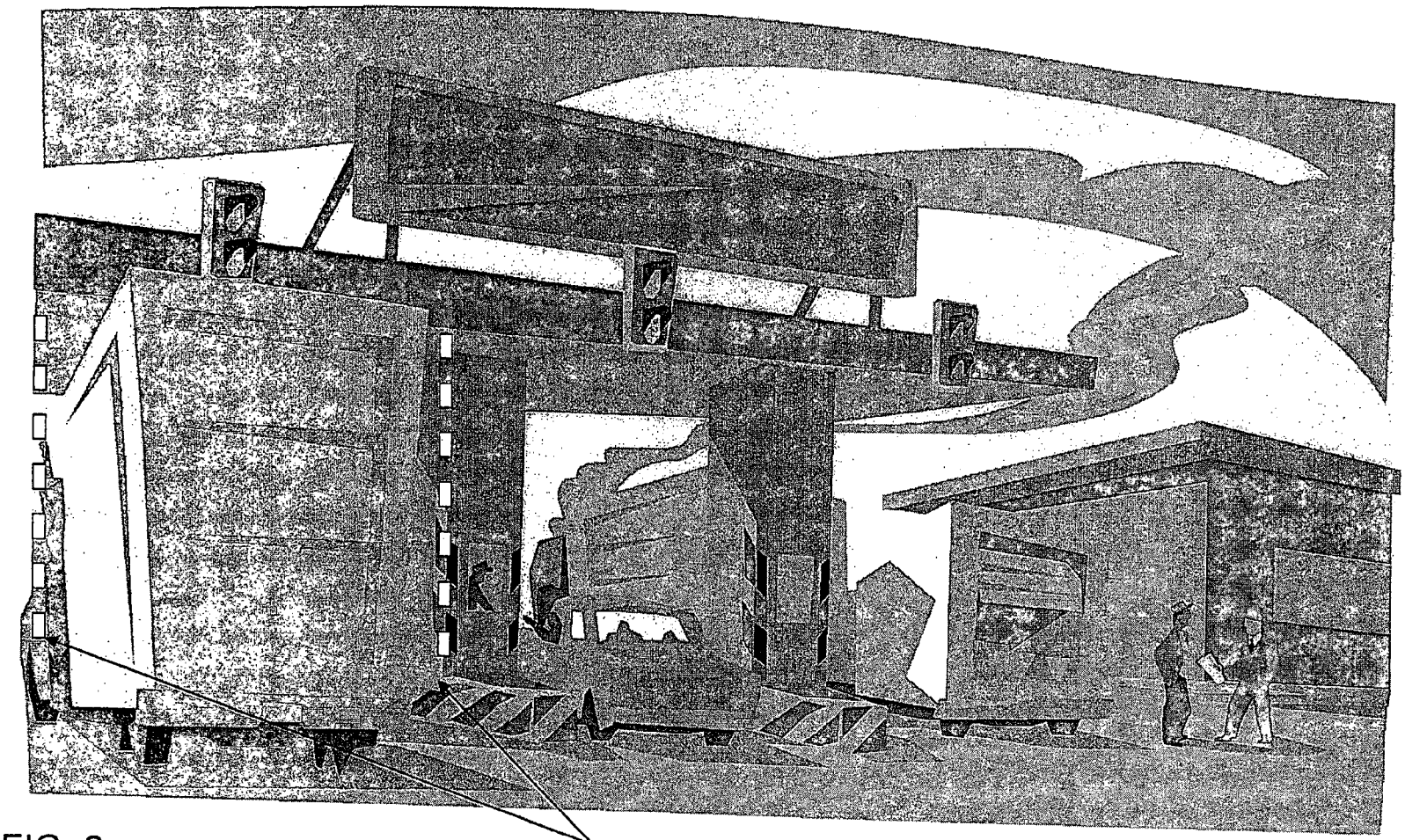
FIG. 2 is a sketch of a security system applied at a border crossing or similar check point.

FIG. 2 illustrates an alternative application of a security system that may be constructed according to the invention. In this example, the security system is used to detect people concealed in an enclosed space, such as a truck. FIG. 2 illustrates trucks passing a border checkpoint. Sensors may be mounted around the periphery of a portal through which trucks pass. Sensors in this embodiment may be microphones designed for low-noise pick up of low-level signals. A boom or other means may be employed to bring the sensors into physical contact with the sides of the truck. Alternatively, the sensors might detect vibrations from a beating heart based on the vibrations induced in the air by vibrations of the side of the truck. Regardless of the specific method of picking up signals, in the described embodiment the signals are processed to detect signals indicative of a beating heart.

Figure 3:
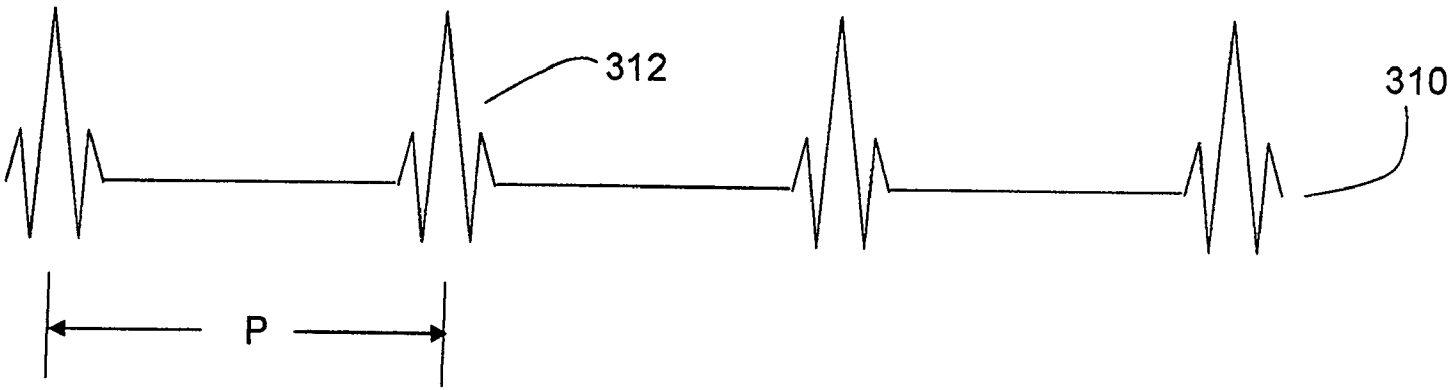
FIG. 3 (prior art)
FIG. 3 is a sketch illustrating a heart beat pattern, as is known in the art.

Signals received by the sensor, regardless of the specific application in which the system is used, may be processed to detect signatures representative of a beating heart or other event. One example of processing that may be performed on the received signals is given in FIG. 3. FIG. 3 illustrates a waveform 310 that represents pressure waves launched by a beating heart. The illustration shows shock pulses 312. These pulses are generally periodic, occurring with a period P. The beat pattern of a heart is known in the art and is sometimes referred to as a "balistocardiogram."

While all beating hearts generally follow the pattern shown in FIG. 3, there can be a wide variation in beat patterns. For example, the heart of an average healthy person beats approximately 60 times per minute. However, heart rates between 40 and 120 beats per minute are not unusual.

To detect such a wide range of possible signals, a security system may be created that includes a library of signatures characteristic of a beating heart. A received signal is compared to the library to detect signals indicative of a beating heart. A system such as is shown in FIG. 1 or FIG. 2 may be modified to employ such a library. In the described embodiment, the modifications are implemented with data processing software in a computer, such as computer 120. However, digital signal processors or other hardware elements may be used to provide the described functions.

Figure 4:
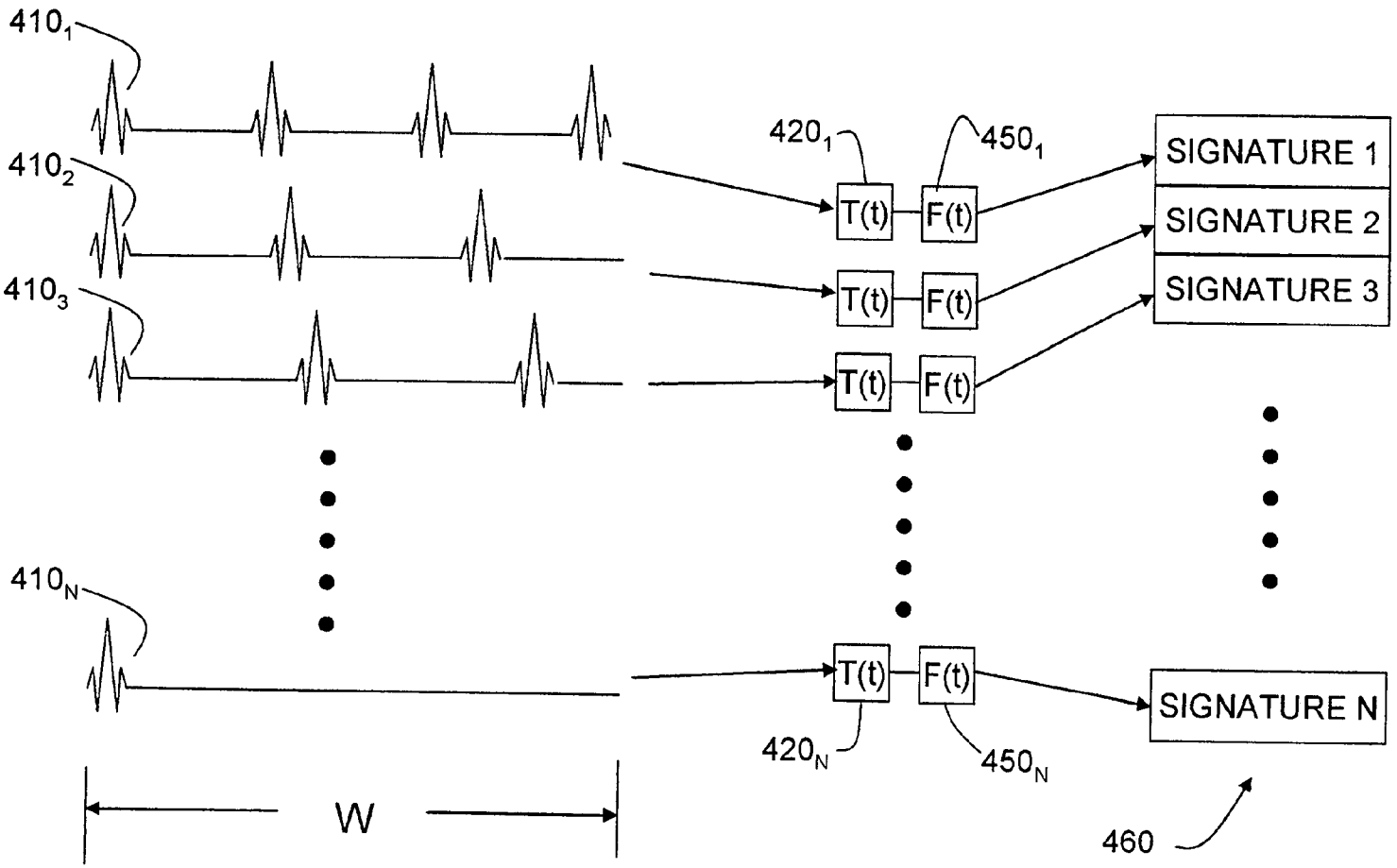
FIG. 4 is a block diagram illustrating the creation of a library of signatures.

FIG. 4 illustrates the process of forming a library 460 of signatures. The process begins with a collection of heart beat patterns $\mathbf{410}_1 \ldots \mathbf{410}_N$. The heart beat patterns are representative of heart beat patterns to be detected. For example, if the security system is intended to detect concealed humans, the heart beat patterns should be those of humans. In contrast, if the system is to detect livestock, the patterns $\mathbf{410}_1 \ldots \mathbf{410}_N$ should be representative of the heart beat patterns of livestock. Likewise, if the system is to detect events other than beating hearts, the patterns used to create a library of signatures should represent signals that may be generated when the event occurs.

Regardless of the specific type of animal or event to be detected, the set of patterns $\mathbf{410}_1 \ldots \mathbf{410}_N$ preferably represents the full range of patterns that may be encountered. For example, if a human heart may beat between 40 and 120 beats per minute, patterns in the set should represent a heart beating in this range. For example, beat pattern $\mathbf{410}_1$ represents a quickly beating heart and beat pattern $\mathbf{410}_N$ represents a slowly beating heart. The other patterns span the range between these extremes.

The number of beat patterns used to create signatures in the library can be varied to reduce the false alarm and false positive rate of the system. However, as more beat patterns are added, the processing requirements of the system increase, such that the number of beat patterns used to create the library cannot be increased arbitrarily. In the described embodiment, on the order of 100 beat patterns are used. More preferably, about 160 beat patterns are used.

In the illustrated embodiment, the amplitude of all of the beat patterns $\mathbf{410}_1 \ldots \mathbf{410}_N$ have been normalized. Alternatively, the beat patterns may be normalized in other ways, such as to have the same energy. Also, FIG. 4 shows that the beat patterns $\mathbf{410}_1 \ldots \mathbf{410}_N$ in the set vary in beat frequency. If the signals to be detected might vary in other parameters, the set used to create the library preferably contains members representative of the range of variations of every parameter and combination of parameters.

The beat patterns $\mathbf{410}_1 \ldots \mathbf{410}_N$ might be obtained empirically by collecting multiple examples of the types of signal to be detected. Alternatively, the beat patterns might be generated through computer modeling and simulation. For example, a shock pulse 312 might be modeled and the set of beat patterns generated by repeating this shock pulse at different periods.

In the embodiment pictured in FIG. 4, each of the beat patterns $\mathbf{410}_1 \ldots \mathbf{410}_N$ has a duration, W. Though a heart beat pattern might repeat for a very long time, a window in time, denoted W, is selected for processing. In the illustrated embodiment, W is on the order of seconds, preferably between 1 and 5 seconds. W is preferably about as long as the period P of the beat pattern with the lowest beat frequency.

FIG. 4 pictures the beat patterns $\mathbf{410}_1 \ldots \mathbf{410}_N$ as continuous signals. However, the described embodiment is implemented through computer data processing. Therefore, all signals are preferably in digital form. If beat patterns $\mathbf{410}_1 \ldots \mathbf{410}_N$ are generated by computer, they will be in digital form. If they are generated from empirical data, they may be in analog form, but can be converted to digital form before further processing using known analog data capture techniques or any other suitable method.

To convert each beat pattern to a signature, the beat pattern is processed by a transfer function T(t). The transfer function represents the effect of the environment on a shockwave generated by a beating heart. For example, in the system illustrated in FIG. 1, transfer function T(t) represents the changes induced in the shockwave generated by the heart of person 110 as the shock wave propagates through the human body and container 112 to sensors 114.

The transfer function T(t) may be obtained by modeling the components of the environment. Known modeling techniques may be used. The transfer function may alternatively be obtained empirically by establishing conditions representative of the conditions under which signals will be detected. For example, an impulse or other signal may be applied and the result measured. Known signal processing techniques can be used to derive the transfer function of a system by measuring the response of the system to a known input. If the container is on a truck with a suspension system, or an elevator suspended on a cable or the signal path includes other mechanically active elements, using a transfer function to compute event signatures may increase the overall accuracy with which events may be detected. In other embodiments, such as when a container is sitting on the ground, stacked on other containers, or the sensors are mounted directly to the container, the transfer function may approximate 1 or may be unknown and processing with a transfer function may be omitted.

Where data is to be gathered empirically, signals in the form of the beat patterns $\mathbf{410}_1 \ldots \mathbf{410}_N$ could be used as the stimulus signals. If this scenario can be created, it is not necessary that the transfer function be ascertained. Rather, the measured value in response to each of the beat patterns $\mathbf{410}_1 \ldots \mathbf{410}_N$ would represent the output of one of the transfer function blocks, such as $\mathbf{420}_1 \ldots \mathbf{420}_N$, which are the signals required for the next step in processing. However, separately generating the transfer function and representative beat patterns allows new entries to be readily added to the library 460 if it is determined that more beat patterns are need to accurately represent the full range of beat patterns or if it is determined that the library needs to be regenerated with a different transfer function.

In the next step of the processing, the signals are transformed according to a transform F(t). As will be described below, a received signal is transformed before comparison to the signatures in the library. In such an embodiment, it is preferable that the beat patterns be similarly transformed before being stored in library 460. In a described embodiment, F(t) represents a frequency domain transform. A known frequency domain transform may be used. For example, a Discrete Fourier Transform (DFT) may be used. However, other transforms may be used, such as the discrete cosine transform. Alternatively, a wavelet transform may be used.

Further, it is possible that a signal may be subject to multiple transforms before being stored in library 460. The transforms may be applied sequentially or separately. Where transforms are applied separately, library 460 may contain multiple entries for each of the beat patterns $\mathbf{410}_1 \ldots \mathbf{410}_N$, with an entry for each beat pattern transformed with each of the transforms.

The transformed beat patterns are preferably stored in library 460 in advance of use of the security system. Preferably, representative patterns are selected and a library is created as the security system is developed. However, it is possible that the library is built adaptively. As items are inspected, data may be gathered to generate new signatures.

Where the types of objects to be inspected vary so widely that some will have substantially different transfer functions, library entries may be generated using each transfer function. For example, where a system may inspect either large or small containers, a transfer function may be generated for each type of container. Each of the beat patterns $\mathbf{410}_1 \ldots \mathbf{410}_N$ would then result in two entries in library 460, one computed with each transfer function.

Figure 5:
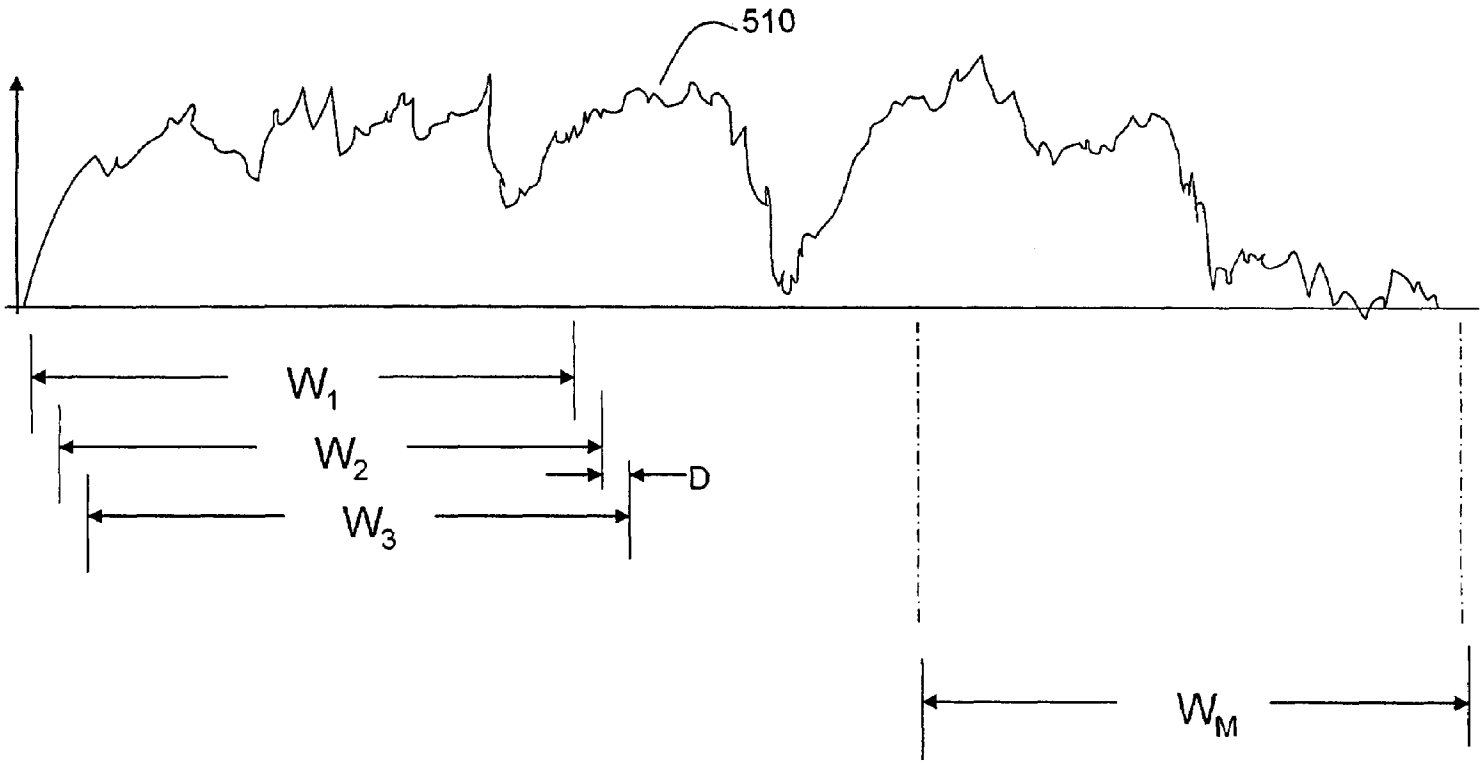
FIG. 5 is a sketch illustrating the formation of windowed signals from a received signal.

Once the library 460 is developed, the system may be deployed as used. FIG. 5 shows a signal 510, such as may be received by one of the sensors 114. Signal 510 does not contain a recognizable heartbeat signal. A heartbeat signal may, however, be present and simply masked by noise. Processing as described below will be performed on signal 510 to detect a heartbeat signal.

As will be described below, signal 510 may be processed in windows. FIG. 5 shows a series of windows, $W_1 \ldots W_M$. Each window preferably has a duration W, which is the duration of signals used to generate signatures in library 460. Further, the windows are spaced in time by an amount D. Preferably, W will be on the order of seconds and D will a fraction of W, preferably on the order of 10's of milliseconds. By dividing signal 510 in this fashion, M separate but overlapping window signals are created for processing. In one embodiment, signal 510 is collected over a duration of approximately six seconds and each window has a duration of approximately four seconds.

Figure 6:
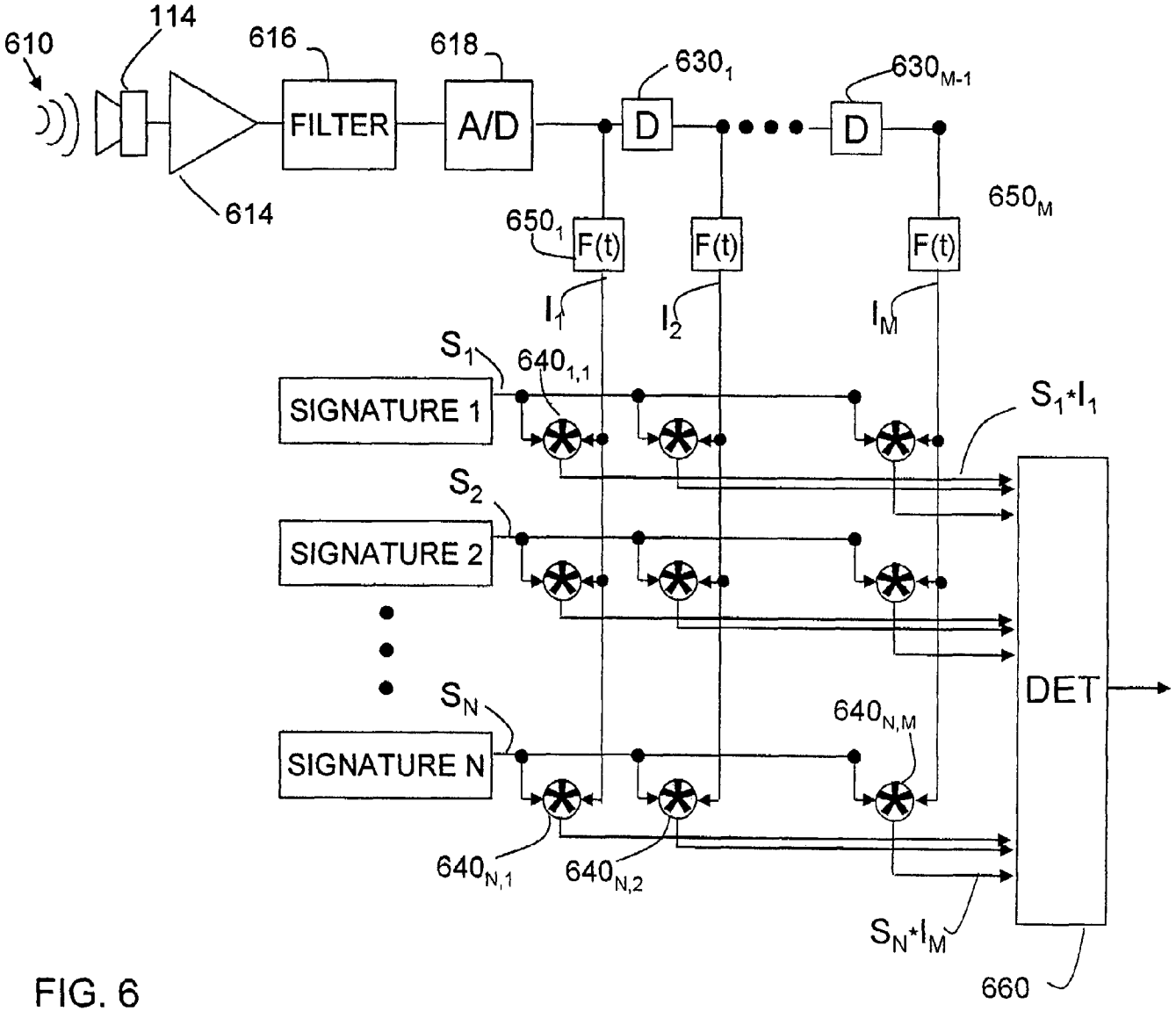
FIG. 6 is a block diagram illustrating processing of windowed signals.

FIG. 6 shows in block diagram form processing that may be used to detect heart beats in signal 510. As shown, vibrations 610 impinge on a sensor 114, which produces an electrical signal. The output of sensor 114 is amplified by amplifier 614 and then filtered in filter 616. Amplifier 414 may be a high gain, low noise instrumentation amplifier as known in the art. Filter 616 may be a signal conditioning filter as known in the art. The resulting conditioned signal is converted to digital form in A/D converter 618. As described above, processing is preferably performed in digital form, but comparable processing operations could be performed on analog signals. If analog processing is desired, A/D converter 618 could be omitted.

The digital signal is provided to a chain of delay elements $\mathbf{630}_1 \ldots \mathbf{630}_{M-1}$. Each delay element provides a delay, D. In this way, the output of each delay element $\mathbf{630}_1 \ldots \mathbf{630}_{M-1}$ forms the signal in one of the windows $W_1 \ldots W_M$ (FIG. 5). The un-delayed signal forms the signal in the first window.

In the embodiment shown in FIG. 6, each of the windowed signals is transformed as illustrated at $\mathbf{650}_1 \ldots \mathbf{650}_M$. Here, a frequency domain transformation is used. In the described embodiment, the transformation is the same transformation used to form the library of signatures. In one contemplated embodiment, two transforms are used—a DFT and a wavelet transform.

The transformed windowed signals are denoted $I_1 \ldots I_M$. Each of the transformed windowed signals is provided to a multiplier array, made up of multipliers $\mathbf{640}_{1,1} \ldots \mathbf{640}_{N,M}$. Each multiplier multiplies one of the transformed window signals $I_1 \ldots I_M$ by one of the signatures $S_1 \ldots S_N$ in the library 460 (FIG. 4). In the described embodiment, each of the windowed signals and each of the signatures in the library spans a time window of duration W and has the same number of values within that window. Accordingly, there is a point-for-point correspondence between values of the signals $I_1 \ldots I_M$ and values in the signatures $S_1 \ldots S_N$. The two signals may be multiplied by multiplying the successive values of the signals point-by-point.

If one of the transformed window signals $I_1 \ldots I_M$ is similar to one of the signatures, $S_1 \ldots S_N$, the two signals should have similar frequency spectra. Thus, the high points of each will align and when the two signals are multiplied, the product signal will have high values corresponding to those high points. In contrast, when a windowed signal does not correspond to a signature, the frequency spectra of the signals will be different and there will be fewer points where the high points of those signals align. As a result, the product signal will contain fewer high points and, the high points are less likely to be as large.

As described above, the received signal 510 is divided into multiple, overlapping windows. Preferably, the width and amount of overlap of the windows is selected to ensure that, if signal 510 contains a heart beat signal, that signal will be aligned in one of the windows $W_1 \ldots W_M$ in a way that aligns with a signature in library 460. Thus, all of the transformed window signals $I_1 \ldots I_M$ are preferably multiplied by each of the signatures $S_1 \ldots S_N$. These products $S_1{*}I_1 \ldots S_N{*}I_M$ are all examined to see which, if any, have values indicating that the window signal matches a signature. These signals are passed to detector 660 for this analysis.

Figure 7:
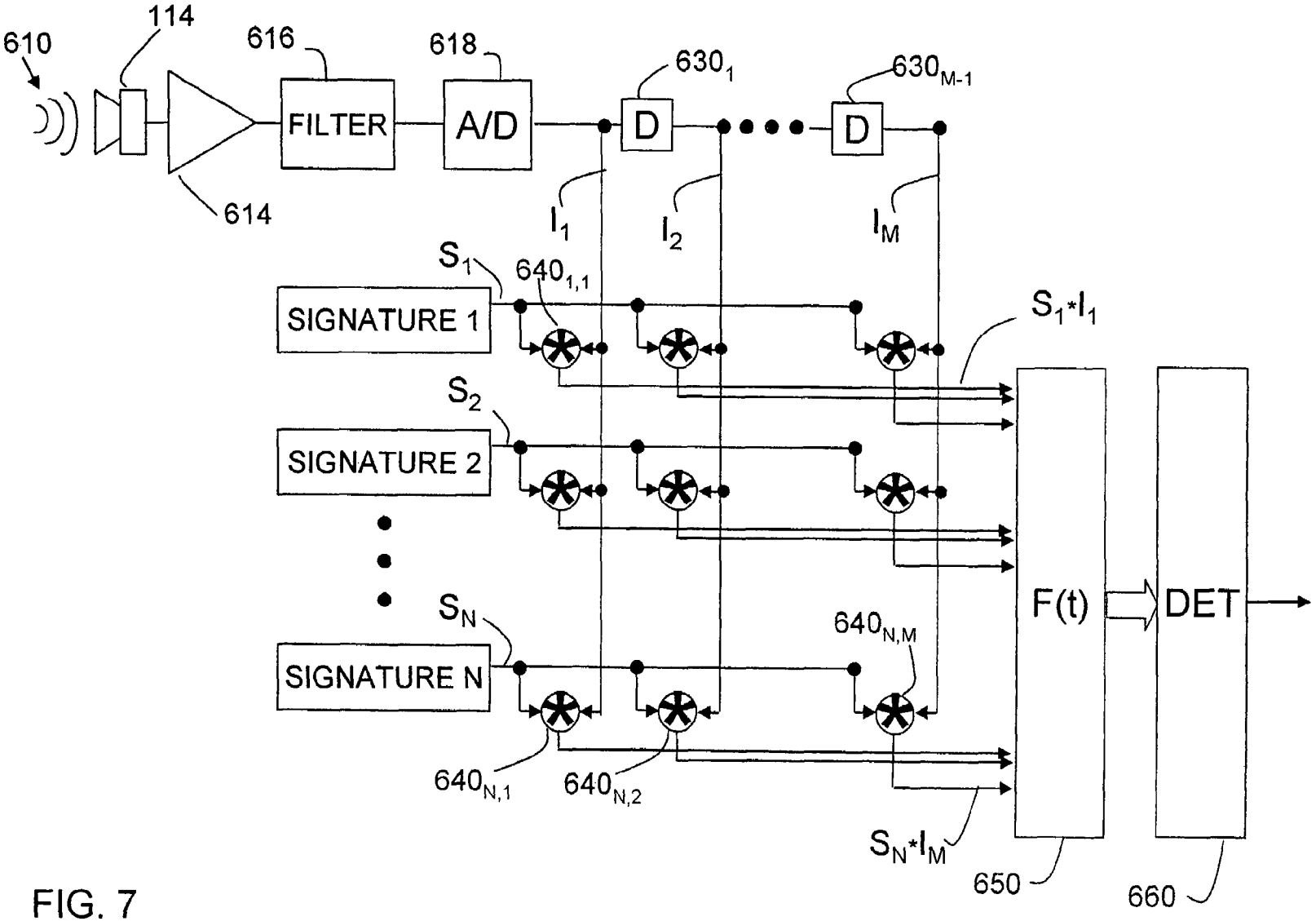
FIG. 7 is a block diagram of an alternative embodiment for processing of windowed signals.

FIG. 7 shows an alternative embodiment of the process for comparing a received signal to signatures in a library. In this embodiment, the windowed signals are multiplied by signatures in the library before they are frequency domain transformed. For this embodiment, the signatures in the library are preferably still time domain signals. Thus, the transformation process at $\mathbf{450}_1 \ldots \mathbf{450}_N$ (FIG. 4) may be omitted in creating the library of signatures for use in this embodiment. However, as in the embodiment of FIG. 6, the received signal is divided into window signals, each of which is multiplied by each of the signatures.

The product signals are then frequency domain transformed, as illustrated at 650. In the illustrated embodiment, each product signal is separately transformed. As described above, one or more known frequency domain transforms may be used. In one contemplated embodiment, a DFT and a wavelet transform are both used, with the transforms being provided in parallel such that each product signal results in two transformed signals. The transformed product signals are then analyzed to detect which, if any, contain, heartbeat signals. Detection is performed by detector 660.

Figure 8:
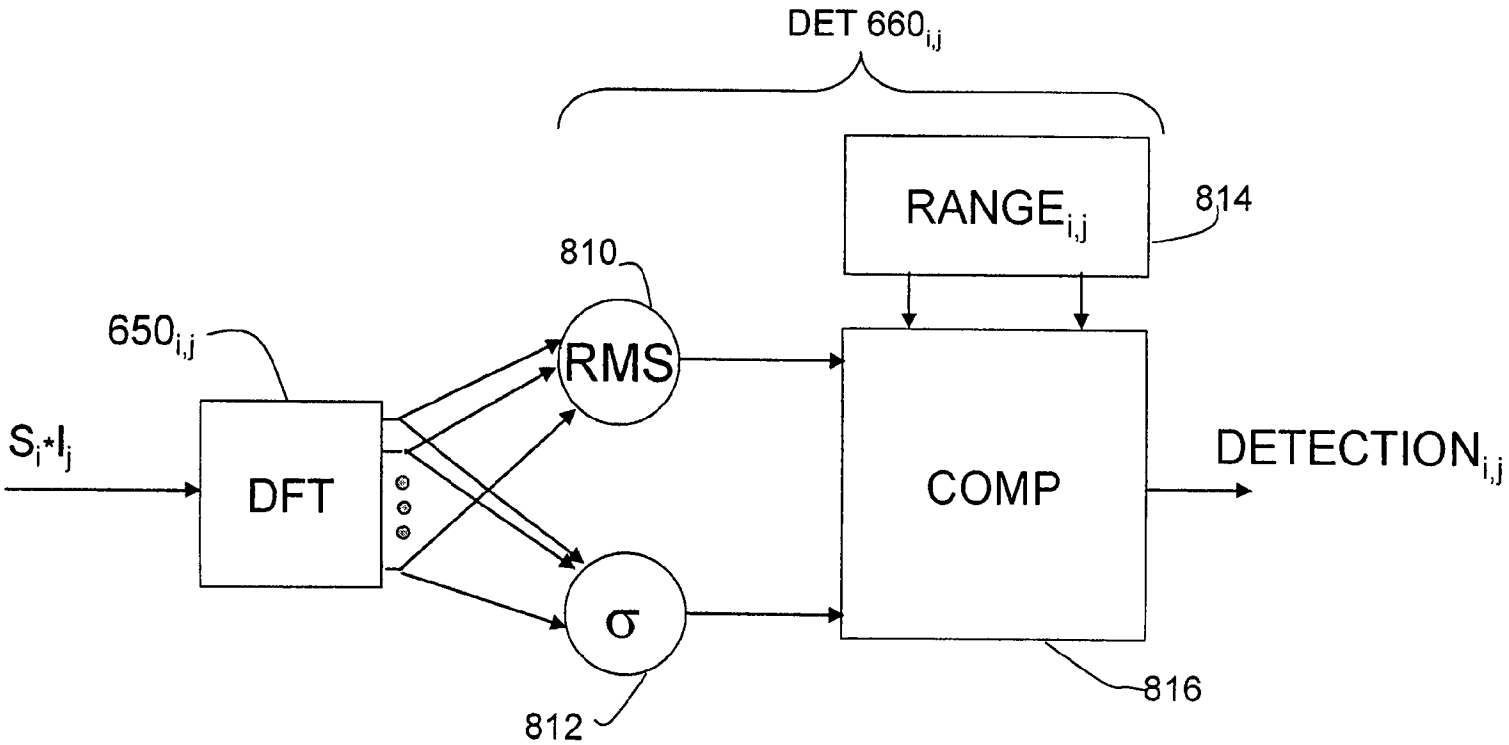
FIG. 8 is a block diagram illustrating in greater detail the detector 660 of FIG. 7.

FIG. 8 shows additional details of detector 660. FIG. 8 illustrates the processing of one product signal. Each product signal may be similarly processed. In the embodiment of FIG. 7, the product signals are transformed to the frequency domain before processing by detector 660. Accordingly, FIG. 8 shows a DFT $\mathbf{650}_{i,j}$ formed on the product signal $S_i{*}I_j$ before application to detector 660. In the embodiment of FIG. 6, a frequency domain transform is performed before the product signal is formed, and DFT $\mathbf{650}_{i,j}$ may be omitted.

The product signal, when transformed to the frequency domain, is a series of frequency values. These values are compared to predetermined criteria to indicate a match between the windowed signal $I_j$ and the signature $S_i$. A match can be taken as an indication that windowed signal $I_j$ contains a heartbeat in the form $\mathbf{450}_i$, which was used to generate the signature $S_i$.

In the described embodiment, the comparison is made using statistical properties of the frequency domain signal. In the illustrated embodiment, these statistical properties are the average value and the variance.

The average value is computed at 810. In the described embodiment, the average is computed according to the Root Mean Square (RMS) method. The variance of the frequency domain values is also computed at 812. Both the RMS and variance are known statistical properties and may be computed in accordance with any known method.

The computed RMS and variance values are provided to comparator 816. Where multiple frequency domain transforms are used, statistical properties of each transformed signal may be computed separately and provided to comparator 816.

Comparator 816 compares the statistical properties of the measured signals to a range or ranges that are indicative of a match. If the computed value for the signal falls within the range, comparator 816 outputs an indication that there is a match.

The predetermined ranges might be the same for all combinations of $S_1{*}I_1 \ldots S_N{*}I_M$. Alternatively, each product signal $S_i{*}I_j$ may have different predetermined ranges. Alternatively, each signature in the library may have different predetermined ranges.

The predetermined ranges may be determined empirically or heuristically. If determined empirically, the values may be computed at the time the system is installed or may be adaptively computed as the system is in operation. Various processes for identifying patterns in data are known and may be employed to set the ranges. For example, data may be collected by applying training signals of known properties and observing the outputs. The outputs may be analyzed to identify the ranges that result when an input signal contains a match to one of the signatures.

As another example, the ranges may be set by computing statistical properties on the frequency properties of the signatures in the library. For example, a match may be determined if the RMS and variance values of the product signal $S_i*I_j$ are within 15% of the RMS and variance values computed for the signature $S_i$.

Regardless of the specific method used to set the range, if the statistical properties of the signal are within the range, a detection is indicated. The indications of a heartbeat may be combined into a security system in multiple ways, such as by triggering a second level inspection of the container.

The system is not limited to detecting heartbeats. Any type of event that generates a signature susceptible of being represented as a signature in a library may be detected. For example, when containerized cargo is stored in a holding area, there may be concern that someone may break into containers for improper purposes. By adapting the system to detect events indicating unauthorized access to a container, a security system for containerized cargo can be created. Detecting a heartbeat inside a container is one way to identify that unauthorized access has occurred. Hammering, sawing, cutting with a torch or other events that occur as someone tries to break into a container generate vibrations that may be transmitted to a sensor such as 114. By using signals indicative of these events to generate signatures in the library, the system may then detect someone breaking into a cargo container. One possible application of such a system would involve sensors attached to multiple cargo container in a cargo yard. Outputs of the sensors may run to a central monitoring station that includes one or more computers to process the data from the sensors and detect efforts to break into a cargo container.

Figure 9:
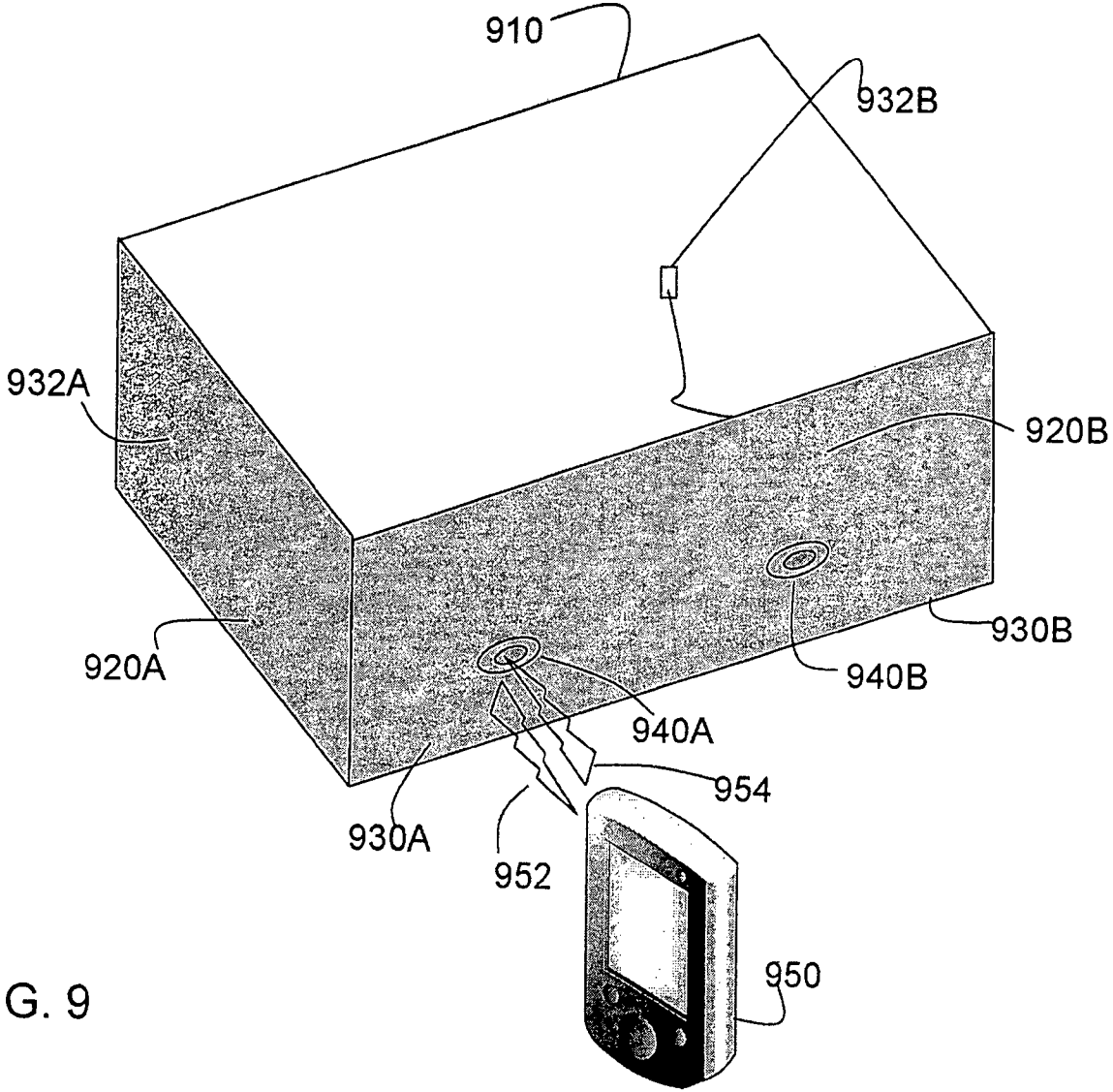
FIG. 9 is a sketch of a cargo container equipped with a security system according to one embodiment of the invention.

An event detection system may also be used as part of a security system for cargo containers in other contexts. For example, a cargo container may be equipped with an event detection system for providing security while the cargo container is in transit. FIG. 9 shows an example of such a system.

Sensors, such as sensors 930A and 932A, may be mounted to cargo container 910. Sensors 930A and 932A may be geophones or other sensors capable of detecting low level vibrational signals. Such sensors output an electrical signal representative of a received vibrational signal. The electrical signal may then be further processed.

Sensors 930A and 932A are connected to processing system 920A. In an embodiment in which a security system is intended for use in connection with cargo containers in transit, processing system 920A may be a self-contained unit. Processing system 920A may include a CPU or other processor as well as non-volatile memory and a self-contained power supply, such as a battery. A self-contained processing system such as 920A allows a security system to operate while the container is in transit, such as on a plane, a truck or a ship, without ready access to another source of power.

Processing system 920A may include components as illustrated in connection with the processing system of FIG. 6. For example, the processing system may include a filter and an analog-to-digital converter. Further, processing system 920A may include a suitable form of computer-readable media containing computer-executable instructions. Those computer-executable instructions may be adapted to control the processor within processing system 920A to process signals received by sensors 930A and 932A to detect events according to a process generally as described above in connection with FIG. 6. Processing system 920A may be programmed with a library of event signatures representing events that may indicate unauthorized access to container 910.

As container 910 is in transit, processing system 920A may monitor the outputs of sensors 930A and 932A to detect events. Processing system 920A may store an indication that an event was detected. The stored indication of the event may be accessed at a later time for further processing.

To allow the stored indication to be accessed, processing system 920A is connected to an interface 940A. Interface 940A provides a mechanism to retrieve data from processing system 920A. In one application, processing system 920A may monitor the outputs of sensors 930A and 932A while container 910 is in transit. Upon reaching a destination or security checkpoint, security personnel may access information stored in processing system 920A to determine whether an event has occurred while container 910 was in transit.

In the illustrated embodiment, interface 940A is a wireless interface. It may receive an interrogation signal 952 and forward the interrogation signal to processing system 920A. Interrogation signal 952 may be in any desired form recognizable by processing system 920A. In response to an interrogation signal 952, processing system 920A may generate a response indicating whether it has detected an event. The response from processing system 920A may be passed back through interface 940A, which forwards it on as response signal 954.

A device such as device 950 may be operated by a security official to generate an interrogation signal 952, and to process a response signal 954. In this way, information concerning unauthorized access to container 910 may be communicated to a security official.

Interface 940A is shown in an example FIG. 9 to be a wireless interface. A wireless interface allows processing system 920A to be interrogated by a security official moving through a shipping facility with a hand-held device, such as device 950. A wireless interface also allows many other types of devices to generate the interrogation signal 952 and capture the response signal 954 for further processing. For example, a device to interrogate processing system 920A may be mounted on a crane or any other convenient piece of equipment handling container 910.

Interface 940A may also communicate data and commands between an external device and processing system 920A. For example, commands sent to processing system 920A may cause the system to start monitoring or stop monitoring. Alternatively, a reset command may be provided to processing system 920A through interface 940A. A reset command may, for example, be given when container 910 is sealed for shipment. Events detected prior to the sealing of container 910 may then be ignored. Further, interface 940 may be used to communicate programs or data, such as data representing signatures of events to be added to the library of signatures within processing system 920A.

Any suitable processor and programming method may be used to implement processing system 920A. However, in one embodiment, processing system 920A incorporates a low power processor to allow the processing system to operate on battery power for an extended period of time while container 910 is in transit. In addition, processing system 920A may be constructed to operate predominately in a low power mode. For example, processing system 920A may be equipped with a timer that is used to periodically initiate processing of signals from sensors 930A and 932A. Alternatively, processing system 920A may be equipped with a level-sensitive circuit that triggers processing system 920A to capture signals from sensors 930A and 932A and process them. In such an embodiment, processing system 920A may operate by default in a low-power mode in which only the monitoring system receives power. When the monitoring system detects input from sensors 930A and 932A of a sufficient magnitude for processing, the monitoring system may trigger a power-up of the other portions of processing systems 920A to collect samples of signals from sensors 930A and 932A.

In the embodiment depicted in FIG. 9, two sensors are coupled to processing system 920A. Incorporating two sensors allows the signals detected by each sensor to be correlated. If the signals detected by both sensors match an event signature, processing system 920A may be detected with higher reliability that an event has been detected. However, any suitable number of sensors may be coupled to processing system 920A and their outputs may be correlated or separately processed.

In some embodiments, it may be desirable to incorporate multiple processing systems. In the embodiment illustrated in FIG. 9, a second security system is shown to include processing system 920B and sensors 930B and 932B. Processing system 920B may communicate through interface 940B. In this embodiment, two independent security systems are incorporated into one container 910. Having two independent systems provides redundancy and also increases the likelihood that events may be detected regardless of where within container 910 signals indicative of those events originate. Any suitable number of security systems may be incorporated into a container. In addition, each security system may be independent or the security systems may share components. For example, security systems may share memory, an interface or other components.

Figure 10B:
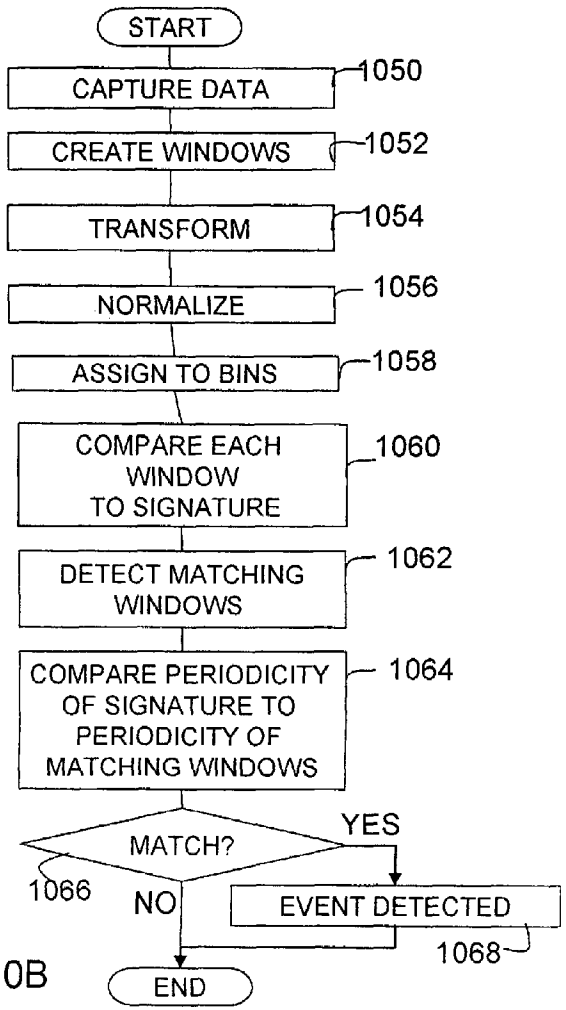
FIG. 10B is a flowchart of a method of detecting events.
Figure 10A:
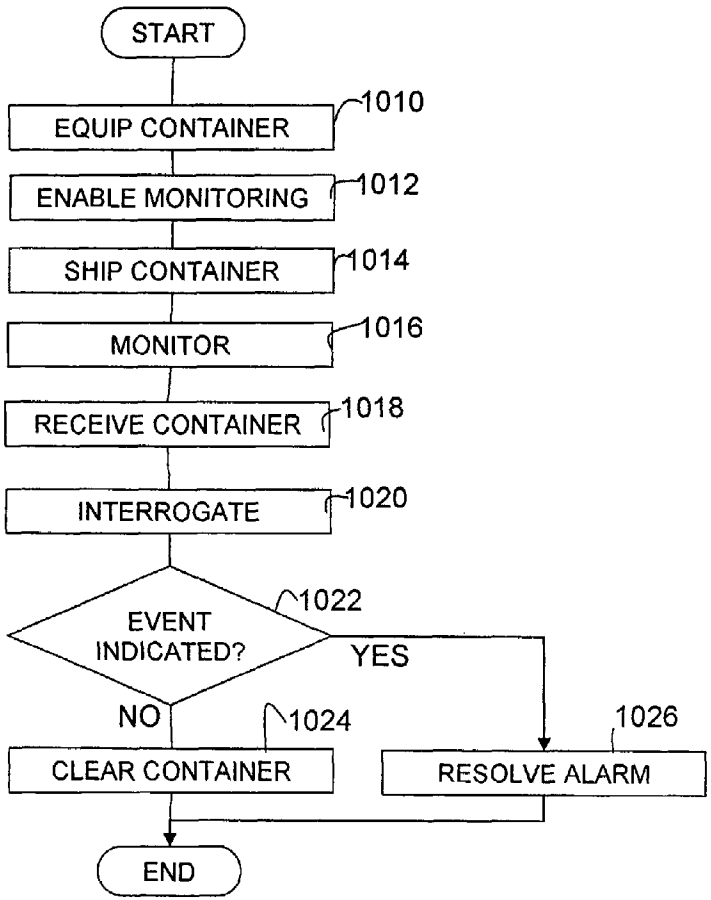
FIG. 10A is a flowchart of a method in which one container of FIG. 9 may be used.

Turning now to FIG. 10A, a process is illustrated by which a container equipped with a security system, such as container 910, may be used. At block 1010, the container is equipped with the security system. Equipping the container may include installing sensors, a processing system and an interface as pictured in FIG. 9. The components of the security system may be installed in such a way as to either prevent and/or detect tampering. For example, the components of the system may be hidden behind panels in the container, enclosed in heavy containers that are not readily opened or equipped with circuitry that detects if any of the sensors are disconnected from the processing system or otherwise disabled or if any alterations are made to data stored in memory or if operation of the processing system is interrupted.

When the container is ready for shipment, the process proceeds to block 1012. At block 1012 monitoring is enabled. Monitoring may be enabled in any desired way. For example, a command may be sent though an interface to the processing system or, before sealing the container, a switch or other input device within the processing system may be activated to enable monitoring.

Thereafter, the container is shipped as indicated by block 1014. While in transit, monitoring may be performed as indicated by block 1016. At block 1016, the processing system or systems within the container may collect samples of the signals from sensors mounted within the container. If an event is detected based on a match between a received signal and an event signature stored within processing system 920A, an indication of the event may be stored within processing system. The indication may be simply a Boolean value indicating that an event has been detected. Alternatively, additional data may be stored concerning the event. For example, the processing system may store an indication of the specific event signature that was matched to a received signal. Additionally, the processing system may store the time that the event was detected or other information useful in subsequent processing of an indication from a system inside the container. If the processing system is equipped to detect tampering, an indication of an event may also be stored in memory if tampering is detected.

The process continues to block 1018. At block 1018, the container is received at a destination or security checkpoint.

At block 1020, the processing system within the container is interrogated. The interrogation allows the indication from events detected by the processing system to be further analyzed. In the embodiment illustrated in FIG. 9, interrogation is performed by an exchange of wireless signals, such as RF or infrared signals. However, any suitable method of interrogation may be used. For example, a cable may be plugged into an interface in the container. Alternatively, physical media may be removed from the processing system and connected to another processing device for analysis.

In some embodiments communication between the processing system internal to the container and an external device may be encrypted or otherwise encoded to promote security. Using encryption may allow an external device to verify that the data sent in response to an interrogation signal was sent by a specific processing system. Additionally, encryption of command signals sent to the processing system may preclude unauthorized parties from resetting the processing to destroy a record of events.

At block 1022, a determination is made whether information obtained by interrogating the processing system indicates that an event occurred while the container was in transit. If no event is indicated, processing may proceed to block 1024 where the container is cleared. Cleared containers may, for example, be allowed entry into a particular port or otherwise allowed to continue to the next phase along their route.

Alternatively, if an event is indicated, an alarm may be raised, indicating that the container has been subjected to suspicious activity. Processing may then proceed to block 1026 where the alarm is resolved. Resolving the alarm may involve further inspection of the container. For example, the container may be physically searched or subjected to inspection using x-rays or other means.

A processing system such as processing system 920A may be programmed to perform any process suitable for detecting events. FIG. 10B shows a flowchart of an exemplary process that may be used. The process begins at block 1050 where data is captured. Data from one or more sensors may be captured by sampling the data and converting it to digital form.

The process continues to block 1052. At block 1052, captured data is formed into a plurality of successive and overlapping windowed signals. Each window is preferably large enough to contain a signal representing an event, such as a heartbeat.

At block 1054, each of the windowed signals is transformed. In the embodiment, illustrated, a frequency domain transform is used. One suitable frequency domain transform is a high-resolution Fourier transform. However, other suitable transforms may be used. The transform performed at block 1054 creates, for each windowed signal, a series of frequency coefficients. Each coefficient represents the frequency content of the windowed signal at a specific frequency.

At block 1056, each of the frequency domain representations of the windowed signal is normalized. In this embodiment, a frequency domain representation is normalized by selecting the largest frequency coefficient. The multiplicative inverse of the largest frequency coefficient is computed and each of the frequency coefficients is multiplied by this inverse value. At the end of the normalization step at block 1056, the largest frequency coefficient in each of the transformed windowed signals will be one and all other coefficients will be normalized to a value less than one.

At block 1058, the normalized frequency coefficients are assigned to bins. Normalizing and assigning to bins facilitates comparison of signals. In one embodiment, five bins are used, having values of 0, 0.4, 0.6, 0.8 and 1.0. Any suitable mapping between the normalized coefficient values and bins may be used. In the illustrated embodiment, normalized coefficients having a value above 0.8 are reset to a value of 1.0. Normalized coefficients with a value above 0.6 and equal to or less than 0.8 are reset to a value of 0.8. Similarly, normalized coefficients above 0.4 and equal to or less than 0.6 are reset to a value of 0.6. Normalized coefficients with values above 0.2 and equal to or less than 0.4 are reset to a value of 0.4. Normalized coefficients with a value of 0.2 or less are reset to equal 0.

With the values of the normalized coefficients mapped to one of a small number of bins, processing continues to block 1060. At block 1060, each of the normalized window signals is compared to a signature. For simplicity, comparison to a single signature is described. But, each signal may be compared to more than one signature by repeating the processing in block 1060, 1062, 1064, 1066 and 1068.

At block 1060, the normalized window signals may be compared to a signature in any suitable way, such as the embodiment shown in FIG. 8. As described above in connection with FIG. 8, each of the normalized transformed windowed signals is multiplied on a point-by-point basis with a signature. Each windowed signal matching the signature may be selected at block 1062 for further processing.

In one embodiment, matching signals may be selected by computing the average and standard deviation of these point-by-point multiplications. The average and standard deviation may be compared to a predetermined range or threshold values, that signify a match to the signature.

Block 1064 indicates a processing step that may be employed for periodic event signatures, such as signatures representative of a beating heart. For example, if the signature represents an event that repeats every half second, it may be expected that the signature of that event will appear in windowed signals representing portions of the original signal spaced apart by half-second intervals. Therefore, at block 1064, the periodicity of the signature is compared to the periodicity of the windows at which a match occurs.

If there is a high level of correlation between the periodicity of the signature and the periodicity of matching windows, processing at block 1066 indicates that an event is detected. If an event is detected, processing continues to block 1068. At block 1068, action appropriate for a detected event may be taken. In the embodiment of FIG. 9, when an event is detected an indication of the event is stored in memory. However, any suitable action may be taken in response to the detection of an event. Conversely, if there is no match between the periodicity of the signature and the periodicity of matching windows, the process of FIG. 10D may end without an indication that an event has been detected. Basing a detection of an event on the periodicity of the signature and periodicity of the matching windows increases the confidence with which an event is detected and therefore reduces the false alarm rate of the system. In some embodiments, the processing is represented by block 1064, 1066 and 1068 may be omitted such that a event is reported as detected when any of the windowed signals matches the event signature.

Having described embodiments of the invention, one of skill in the art will appreciate that multiple alternative embodiments might be created.

For example, the system for detecting events is shown used in connection with shipping containers for containerized cargo. The system may be applied in other applications, such as to detect events, including heartbeats, in other spaces where vibrational signals can be detected, such as elevators, hallways, restricted areas of buildings. The system also may be used to detect signatures in a space that are unrelated to the detection of a person or animal, but which could signify an event related to breaching the space or other event of interest.

Also, it was described that the system is used as a stand-alone system to detect unauthorized access to a container. Other uses are possible. For example, the system may be used as either a pre-scanner or post-scanner for another security system. For example, the system may be used in connection with an infrared system that may detect unauthorized access to an area by detecting body heat. A system to detect heartbeats as described above may be used to select areas to scan using infrared technology. Alternatively, the system may be used to verify whether a living person is contained with a space indicated by a IR scanner to contain a person. More generally, the data generated by the system may be fused with data from any other source for enhanced processing.

The data that may be fused could come from multiple sensors that measure the same property to increase confidence that an event has been detected when the event is detected by multiple sensors. For example, data from multiple sensors that detect motion of a door may be fused to increase the confidence that a signal represents opening of the door rather than flexing of the door caused by pressure on the door. Alternatively, data may be fused from sensors that measure different properties. Examples of data fusion that are possible include incorporation of a light sensor with a sensor that detects vibrational signatures indicative of a piercing of a container. If a vibrational signature indicative of piercing a container is detected in conjunction with an increase of light in the container, a breach of the container is indicated with a higher level of confidence.

Likewise, examples of the system are provided in which signals generated by vibrational sensors are processed. The processing methods above are not limited to processing data generated by vibrational sensors. In some embodiments, vibrational signals are described to be detected after propagation through an object, such as the wall of a container. In the embodiment of FIG. 2, it is described that vibrational signals are detected with a microphone after they propagate through air because it is inconvenient to position a vibrational sensor on the container walls. It is possible that vibrational signals propagating through air may be detected and processed, even if a vibrational sensor could be mounted to an object, such as a container. For example, sensors mounted in an elevator or other enclosed space could detect sound rather than vibration propagated through the walls of the enclosed space.

The same processing approach may be employed in connection with data derived from any source to detect whether those signals contain components indicating that an event has occurred. Other sources of data include other sensors, such as chemical or biological sensors in which specific signatures would be analyzed to detect an event. Data could also be derived from sensors that measure a quality of air or water to provide air or water monitoring.

As an example of another variation, FIG. 1 shows a single computer 120. Generally, data may be collected, processed and output by one or more processors in any suitable configuration, which could be a single computer or multiple computers interconnected by a network. For example, an embodiment was described as being implemented in software programmed on a computer work station, which might be a standard desk top computer. A more sophisticated computer, including multi-processor work stations might be employed. Further, array processors and dedicated signal processing hardware, including Application Specific Integrated Circuits (ASICs) may be used to implement the described processes.

As another example of a variation, the described embodiments include delay elements to produce window signals. If the system is not implemented to perform real time processing, physical elements introducing delay into a data stream may not be required. The delay may be introduced by storing the entire signals and retrieving the desired portions when needed.

As another example, it is described that the received signal is divided into multiple overlapping windows so that a heartbeat signal in the received signal will appear in one of the windows with the same alignment as the signal used to create a signature in the library. A similar effect may be achieved in other ways. For example, the library could contain multiple signatures for each of the heartbeat patterns $\mathbf{410}_1 \ldots \mathbf{410}_N$, with entries derived by shifting each heart beat pattern by an amount D before forming the signature. Alternatively, the signatures in the library may be time shifted to generate multiple signals before use instead of or in addition to forming overlapping windows for the received signal as shown in FIG. 5.

As a further example of possible variations, the orders of various operations might be reversed. For example, FIG. 4 shows a transfer function followed by a frequency domain transform. The order of these operations might be reversed by representing the transfer function in the frequency domain. As another example, FIG. 4 shows that the transfer function is applied before signatures are stored. The signatures could be stored without applying the transfer function and the transfer function could be applied as the signatures are retrieved from the library. Such an embodiment may be useful, for example, if the transfer function may be different for different items under inspection. For example, if multiple types of containers are to be inspected, it might be desirable to select the transfer function appropriate for the specific container under inspection.

Similarly, FIG. 6 shows a transform being applied to each delayed signal before it is multiplied by a signature library 460. In this embodiment, a frequency domain transform is applied to each signature before it is stored in the library. FIG. 7 shows alternative processing in which the transform 650 is applied after each delayed signal is multiplied by a signature. In this embodiment, signatures in the library may not be transformed at all.

Also, it was described that a windowed signal and a signature are compared by a point to point multiplication. This multiplication might be viewed as a form of convolution. Other forms of convolution might be used. Related functions, such as a correlation function might be used to compare the signals to the signatures.

Further, while the DFT and wavelet transform are described, other transforms might be used.

Moreover, the statistical properties used to ascertain whether a windowed signal matches a signature are illustrative. Other types of averages or other functions that indicate the distribution of values might be used.

As a further example, each window signal was described to be processed independently. Additional information may be obtained by further processing, such as by comparing or combining the results of computations on multiple window signals. For example, if a window, $W_X$ is determined to contain a signal matching a heartbeat pattern with a period P, a later window $W_{X+Y}$ should also match that same heartbeat pattern. Here Y can be computed by diving the period of repetition of the heartbeat pattern, P, by the spacing D between windows. The confidence of the detection may be significantly increased if the patterns of windows matching heartbeat patterns are analyzed.

In the described embodiment, the output of each sensor 114 may be independently processed using the above described approach. As another example of post processing that might be employed to improve performance of the system, the outputs of multiple sensors might be compared to ascertain whether a heartbeat was detected in the signal from multiple sensors.

Preferably, the received signal is normalized before processing. The normalization step is not explicitly shown. Preferably, the signal in each window is normalized separately. However, normalization might take place at any convenient place in the processing. For example, amplifier 614 might contain automatic gain control, which would provide a form of normalization.

Further, the described application of the system is illustrative rather than limiting. The system was described in connection with detecting stowaways in containerized cargo. The system might be used in any situation where it is desired to find a concealed person or animal. It might, for example, be used to ensure that no people are concealed in building or other areas. In other instances, the system might be used when it is necessary to ascertain that no people are in an area. For example, the system might be used to ascertain that no students have been inadvertently left on school busses parked in a lot at the end of the day. The system might be used as a pre-preprocessor on an X-ray inspection system to detect contraband items in containers. The system might be used to ascertain that no people are present and it is safe to irradiate a container.

I claim:

1. A container, comprising:

a) a vibration sensor;

b) a processor, coupled to receive a signal from the vibration sensor and adapted to process the signal to detect a pattern of vibration characteristic of an unauthorized opening of the container, the processor comprising computer storage media storing a library comprising a plurality of event signatures, each event signature representing a frequency spectrum of an event signal generated by an event as detected at the vibration sensor, the plurality of event signatures including an event signature representing the unauthorized opening; and the processor being adapted to:

form a plurality of frequency domain representations of the signal, each formed from a portion of the signal;

compare each of the plurality of frequency domain representations of the signal to the plurality of event signatures; and detect the unauthorized opening of the container based on the result of the comparisons; and c) an interface, coupled to the processor and adapted to communicate an indication of whether the pattern was detected.

2. The container of claim 1, wherein the interface comprises a wireless interface.

3. The container of claim 2, wherein the interface is adapted to communicate the indication in response to an interrogation signal.

4. The container of claim 1, wherein the indication is encrypted when communicated.

5. The container of claim 1, wherein the processor comprises computer-readable media comprising a plurality of computer-executable instructions for comparing at least a portion of the signal to each of a plurality of event signatures and identifying the pattern characteristic of an event based on similarity of the signal to an event signature of the plurality of event signatures, whereby the computer-executable instructions adapt the processor to detect the unauthorized opening of the container.

6. The container of claim 1, additionally comprising computer memory and wherein the processor is adapted to store at a first time data signifying that the pattern was detected and to communicate at a second time the data through the interface as the indication.

7. The container of claim 1, additionally comprising a low pass filter and wherein the processor is coupled to the sensor through the low pass filter.

8. The container of claim 1, additionally comprising a second sensor coupled to the processor.

9. The container of claim 1, additionally comprising a second sensor, a second processor coupled to the second sensor and a second interface coupled to the second processor.

10. A method of operating a security system for a container, comprising the acts:

a) monitoring vibrations of the container to detect a vibration signal having a characteristic representative of an undesired access to the container while the container is en route to a destination, the detecting comprising:

forming a plurality of frequency domain representations of the vibrations, each frequency domain representation formed from a portion of the vibrations;

comparing each of the plurality of frequency domain representations of the signal to a library comprising a plurality of event signatures;

detecting the unauthorized opening of the container based on the result of the comparing;

b) storing an indication when the vibration signal characteristic is detected; and c) at the destination, retrieving the stored indication and taking a security action in response to the stored indication.

11. The method of claim 10, wherein the act a) comprises monitoring vibrations to detect a vibration signal having a characteristic representative of a container wall being cut.

12. The method of claim 10, wherein the act a) comprises monitoring vibrations to detect a vibration signal having a characteristic representative of a person inside the container.

13. The method of claim 10, wherein the destination is a security checkpoint.

14. The method of claim 13, additionally comprising:

d) transferring the stored indication to a processor outside the container at the security checkpoint.

15. The method of claim 14, wherein transferring the stored indication comprises transmitting data representative of the indication through an interface on the container.

16. The method of claim 13, additionally comprising the act:

d) clearing the container when no indication is stored.

17. The method of claim 10, wherein the act a) comprises monitoring vibrations with a plurality of sensors and detecting a vibration signal comprises comparing vibration signals detected with each of the plurality of sensors.

18. A method of detecting an event in relation to a container, comprising:

a) providing a library comprising a plurality of event signatures, each event signature representing the frequency spectrum of an event signal generated by an event and passing through the container, the providing accomplished by:

i) generating a plurality of event signals, each representative of an event; and ii) computing a plurality of estimated signals by applying to each of the plurality of event signals a transfer function characterizing a signal path including the cargo container;

b) obtaining a vibration signal representative of vibrations of the container;

c) forming a plurality of frequency domain representations of the vibration signal, each formed from a portion of the vibration signal;

d) comparing each of the plurality of frequency domain representations of the vibration signal to the plurality of event signatures; and e) detecting an event based on the result of the comparisons of act d).

19. The method of claim 18 wherein the act c) comprises performing a discrete transform on each of a plurality of successive and overlapping windows of the vibration signal.

20. The method of claim 18 wherein the act a) further comprises:

iii) generating the plurality of event signatures by performing a frequency domain transform on each of the plurality of estimated signals.

21. A method of detecting an event in relation to a container, comprising:

a) providing a plurality of event signatures, each representing the frequency spectrum of an event signal generated by an event and passing through the container;

b) obtaining a vibration signal representative of vibrations of the container;

c) forming a plurality of frequency domain representations of the vibration signal, each formed from a portion of the vibration signal;

d) comparing each of the plurality of frequency domain representations of the vibration signal to the plurality of event signatures, the comparing comprising:

i) normalizing each of the plurality of frequency domain representations of the vibration signal and, ii) wherein each of the frequency domain representations comprises a plurality of frequency values and the act d) further comprises mapping each frequency value to one of a plurality of bins; and e) detecting an event based on the result of the comparisons of act d).

22. The method of claim 18, additionally comprising:

e) obtaining a second vibration signal, correlated in time with the first signal, and f) performing the acts c) and d) on the second vibration signal, wherein the act e) comprises detecting an event based on the result of the comparison performed in the act d) on the vibration signal and the comparison performed in the act d) on the second vibration signal.

23. The method of claim 18, wherein:

the plurality of event signatures represent event signals with a periodicity;

the act d) comprises selecting a plurality of portions of the vibration signal that match one of the plurality of event signals, the selected plurality of portions having a periodicity; and the act e) comprises detecting the event when there is a harmonic relationship between the periodicity of the one of the plurality of event signals and the periodicity of the selected portions.

* * * * *